US005360111A

United States Patent [19]

Arispe

[11] Patent Number: 5,360,111

[45] Date of Patent: Nov. 1, 1994

[54] COMPACT LOTION APPLICATOR

[76] Inventor: Steven E. Arispe, 11793 Briar Knoll Pl., Moreno Valley, Calif. 92557

[21] Appl. No.: 116,008

[22] Filed: Sep. 2, 1993

[51] Int. Cl.[5] ..... B65D 85/00

[52] U.S. Cl. ..... 206/361; 224/207; 224/219

[58] Field of Search ..... 132/297, 317, 318; 206/229, 361, 362, 362.1, 362.2, 362.4, 581, 823; 224/207, 219

[56] References Cited

U.S. PATENT DOCUMENTS

| | | | |
|---|---|---|---|
| D. 297,467 | 8/1988 | McCann | D28/7 |
| 1,713,264 | 5/1929 | Coryell | 132/297 |
| 1,782,024 | 11/1930 | Aronson | 132/297 |
| 2,547,971 | 4/1951 | Polin et al. | 132/297 |
| 2,621,784 | 12/1952 | Van Boytham | 206/361 |
| 2,823,681 | 2/1958 | Miller | 206/229 |
| 3,053,381 | 9/1962 | Schmid | 206/385 |
| 4,393,975 | 7/1983 | Moore | 206/385 |
| 4,555,020 | 11/1985 | Campello et al. | 206/823 |

*Primary Examiner*—Jimmy G. Foster
*Attorney, Agent, or Firm*—Andrew Jordan

[57] ABSTRACT

A compact applicator for tanning lotions and the like reattachably disassembles. A telescoping handle removably attaches to an applicator base. When disassembled from the applicator base, the telescoping handle collapses and with the applicator base, fits within a closable compact for easy carrying and storage.

9 Claims, 1 Drawing Sheet

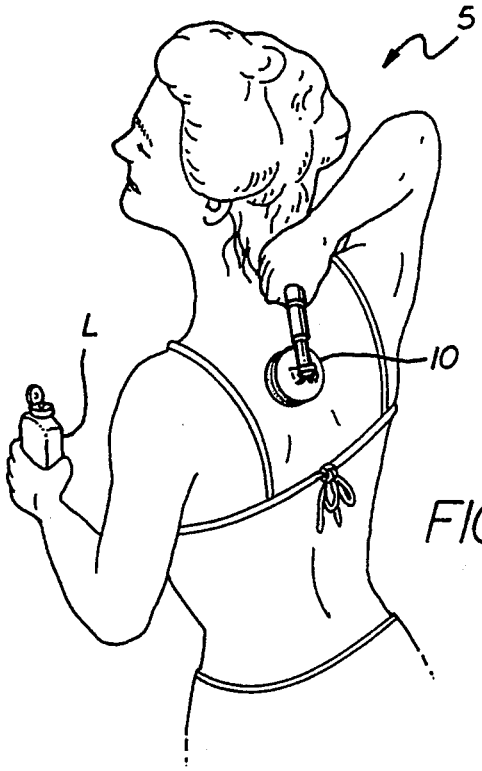
FIG. 1
FIG. 2
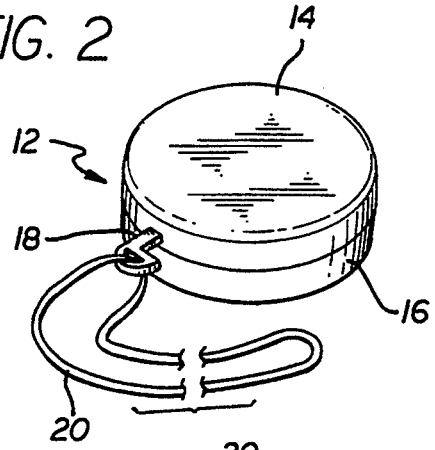
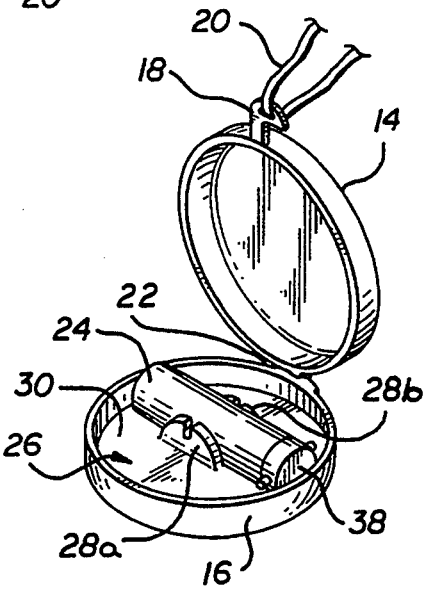
FIG. 3
FIG. 5
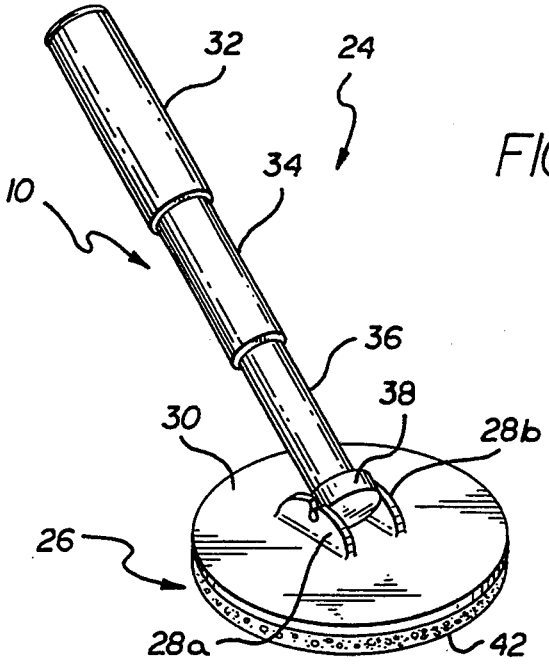
FIG. 4
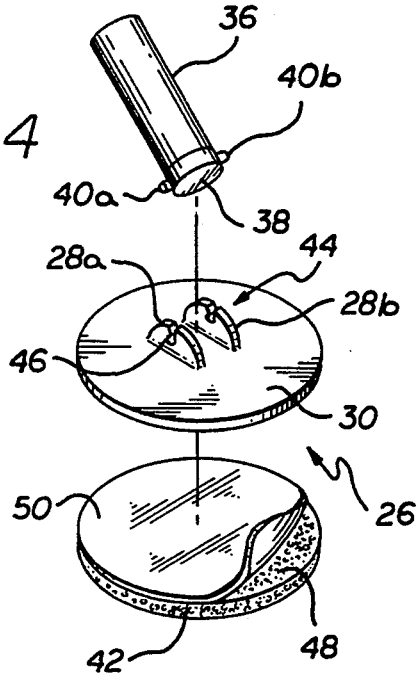

COMPACT LOTION APPLICATOR

BACKGROUND OF THE INVENTION

1. Field of the Invention

This invention relates to lotion applicators and more particularly to an applicator for suntan lotion that is selfcontained and readily available to the user.

2. Description of the Related Art including information disclosed under 37 C.F.R. § 1.97–1.98

Currently, when bathers go outside to enjoy the sun by the seashore or swimming pool, suntan oils and lotions are often used to protect them from the harmful effects of the sun's ultraviolet radiation. It has been shown that the ultraviolet radiation from the sun contributes significantly to instances of skin cancer, especially to those with pale or sensitive skin. Suntan oils and lotions are readily available through drug or grocery stores and are applied directly to the skin. Many suntan oils and lotions are available in a variety of sun protection factors or SPFs that indicate the ultraviolet radiation absorbing capacity of the particular oil or lotion. A higher SPF absorbs more ultraviolet light than a lower SPF and better protects the bather from harmful ultraviolet exposure.

When a sun bather is out in the sun, he or she applies the lotion directly to all areas of his or her skin that may be exposed to the sun. Primarily the lotion is applied by hand, making the bather's hand and all that it touches somewhat greasy or oily from the suntan oil or lotion. This greasy or oily characteristic of suntan oils and lotions can be a drawback as it is advantageous to keep one's hands clean. Handling or touching objects with oily or greasy hands imparts the oil or grease to the object touched which can require inconvenient cleaning of the objects so touched, such as sunglasses. Further, as many sun bathers choose to eat or snack while they are out in the sun, they often do so by hand, and it is not uncommon for traces of suntan oil or lotion to be ingested by the sunbather. Ingestion of suntan oil or lotion is obviously something to be avoided as the suntan lotion is meant for external and not internal use.

Furthermore, because suntan oil or lotion is manually applied to the skin of the bather, if the bather is bathing alone or covers him or herself with lotion or oil solely by their own hands, there can be exposed patches left uncovered as the hands of the bather may not reach all those areas exposed to the sun. One such area is the space in between the shoulder blades of the bather which is often exposed to the sun as the bather lies stomach down on the ground exposing the back to the sun. Additionally, there may be external skin regions that are accessible, but inconveniently so, so that the bather cannot easily reach these places in order to apply sun protecting lotion to them.

Due to the foregoing, it can be seen that it would be advantageous to provide the sunbather with an applicator that could replace the bather's hands in applying lotion so that the bather's hands remain clean. Further, such an applicator should reach all exposed areas of the body that should be covered with lotion. Such a lotion applicator is most advantageously realized when it is easily carried by the bather, and when it does not occupy much space. Further enhancements for such an applicator are realized by one that is easily manufactured from sturdy and resilient materials at an inexpensive price.

As is shown and described herein, such a lotion applicator is realized by the present invention.

SUMMARY OF THE INVENTION

The present invention is a compact suntan lotion or oil applicator that is self-contained, that occupies a minimum amount of space, and is able to reach otherwise inaccessible or inconveniently accessible places on the skin of the sun bather while allowing the sunbather's hand to remain clean.

A folding compact case is provided that encases the lotion applicator proper. The folding compact provides a space within which the lotion applicator of the present invention is contained. The compact is generally cylindrical or disk-shaped and is divided in two across its widest portion. A strap can be attached to the compact by means of a strap hook or clasp that encloses a cord that can be worn at the wrist or around the neck of the sunbather. A hinge is provided that couples the two generally similar halves of the compact, allowing the compact to securely open and close, while maintaining a juncture between the top and bottom halves of the compact. A clasp or latch may be provided to snap shut or otherwise keep the compact closed once the top portion of the compact has been pivotably brought against the bottom portion.

Within the compact, the lotion applicator proper fits within the cavity provided by the top and bottom halves of the compact. The applicator itself has a telescoping handle that detaches from a generally flat and circular lotion-application portion. The telescoping handle allows the applicator to reach otherwise inaccessible body portions as it extends the hand of the sunbather. The telescoping handle is pivotally connected to the applicator base. The applicator base has a soft and absorbent pad that is preferably made of a durable and washable foam rubber such as neoprene or urethane. The pad is coupled to the telescoping handle by means of a rigid, platter-like base. The base has two tab pin holders on the side opposite the absorbent pad. The telescoping handle pivotably articulates within the tab pin holders once it is so connected.

The telescoping handle may be detached from the rigid base, and thereby from the foam pad, by snapping free two tab pins present at the end of the telescoping handle from the tab pin holders of the rigid base. Likewise, the telescoping handle can be connected to the rigid base by snapping the tab pins into the tab pin holders of the rigid base. The telescoping handle can be both connected and disconnected from the rigid base without injuring the applicator. Once disconnected from the base, the telescoping handle may fold to collapse as allowed by its telescoping nature. The handle may then be fitted snugly between the two tab pin holders of the rigid base. The length of the folded telescoping handle is not greater than the diameter of the base. When the telescoping handle is fitted between the two tab pin holders of the base, the entire lotion applicator fits within the compact. When closed, the compact may serve to keep the applicator safe from external dust and dirt, and also to provide a convenient manner of carrying the applicator by the sunbather.

OBJECTS OF THE INVENTION

It is an object of the present invention to provide a compact suntan location applicator occupying a minimum of space.

It is an object of this invention to provide a sturdy lotion applicator that can be easily manufactured of inexpensive materials.

It is another object of this invention to provide a suntan lotion applicator that is convenient to use.

It is another object of this invention to provide a lotion application that can reach otherwise inaccessible patches of exposed skin.

It is yet another object of this invention to provide a compact suntan lotion applicator that is attractive and visually appealing.

These and other objects and advantages of the present invention will be apparent from a review of the following specification and accompanying drawings.

BRIEF DESCRIPTION OF THE DRAWINGS

FIG. 1 shows a rear perspective view of a sunbather using the applicator of the present invention in the right hand while holding a bottle of suntan lotion in the left.

FIG. 2 is an upper perspective view of the compact containing the lotion applicator of the present invention, the compact being closed.

FIG. 3 is an upper perspective view of the lotion applicator of the present invention showing the compact in its open form with the lotion applicator in its most compact and folded form with the telescoping handle fitting between the tab pin holders of the applicator and its rigid base.

FIG. 4 is an exploded perspective view of the applicator of the present invention showing the end of the telescoping handle, the rigid base, and the applicator pad with the backing strip of a peel and stick applicator pad shown partially pulled away from the applicator pad.

FIG. 5 shows a perspective view of the applicator of the present invention shown in its connected and assembled form with the telescoping handle fully extended, pivotally coupled to the rigid base of the applicator and its pad.

DESCRIPTION OF THE PREFERRED EMBODIMENT(S)

As shown in FIG. 1, the suntan lotion applicator 10 of the present invention can be used by a sunbather S to reach inaccessible and exposed portions of the body such as the portion of the back between the shoulder blades. The suntan lotion applicator 10 of the present invention can also be used to keep the hands free and clear of suntan lotion itself, as well as providing an easier means of reaching other inconveniently accessible portions of the sunbather's skin.

Throughout this description, reference is made to suntan oils and lotions. For ease of reference, the term suntan lotion refers to all creams, lotions, oils, or other forms of sun protection that can be applied to the human skin in liquid or semi-liquid form.

FIGS. 2 through 5 show in various views the lotion applicator 10 of the present invention. In its most compact form, FIG. 2 shows the compact portion 12 of the present invention in a folded compact 12 that occupies the space of approximately three inches in diameter by two inches in height. The compact portion 12 is cylindrical or disk-shaped. The compact portion 12 of the present invention has a top portion 14 that is hingeably attached to a bottom portion 16. The top portion 14 of the compact 12 takes up approximately one-half of the compact 12 with the bottom portion 16 also taking up approximately one-half of the compact 12. In alternative embodiments, it may be convenient to allocate the top and bottom portions 14, 16 of the compact 12 in a different manner such as by providing a very shallow top and a very deep bottom, or vice versa.

In order to better provide the sunbather S with means for carrying the applicator compact, a strap loop or clasp loop 18 may be provided on either the top 14 or bottom portion 16 of the compact 12. A cord 20 can be passed through a hole in the strap loop 18 so that the applicator compact 12 can be easily carried as around the wrist or neck of the sunbather S. It may also be advantageous to provide some means of keeping the compact 12 closed once it has been shut. Such means may include a latch or clasp (not shown) that holds the two compact halves 14, 16 together once the compact has been closed, such as by a snap fit or by other means. Alternatively, the hinge 22 holding together the applicator compact 12 may be biased to hold the compact halves 14, 16 closed.

As shown in FIG. 3, the top and bottom halves 14, 16 of the compact 12 serve to provide a protected space within which the applicator 10 itself can be placed when it is not in use. The applicator 10 fits easily within the defined space between the top and bottom portions 14, 16 of the compact 12 as the handle portion 24 of the applicator 10 removably detaches from the base portion 26 of the applicator 10. The handle 24 telescopes to form an elongated extension, but is kept in its collapsed form when held inside the applicator compact 12. The length of the collapsed, telescoping handle 24 is less than the interior diameter of the compact 12 so that the collapsed, telescoping handle 24 may fit easily within the applicator compact 12. When held inside the applicator compact 12, the collapsed telescoping handle 24 fits between two upstanding tab pin holders 28*a*, 28*b* present centrally on the rigid platform portion 30 of the lotion applicator 10.

As shown in FIGS. 4 and 5, the telescoping handle 24 has a plurality of nested, telescoping segments. As shown in FIG. 5, three segments are shown: an outer telescoping segment 32, a middle telescoping segment 34, and an inner telescoping segment 36. A greater or fewer number of nested, telescoping segments can be used in the present invention so long as the utility of the present invention is maintained, and so long as the manufacturing constraints are not overly burdensome. The use of three telescoping segments is seen to provide some advantages as it is simple in design and mechanically uncomplicated. When the telescoping handle 24 is extended, each segment extends from its corresponding adjacent outer segment to lock by means of friction or otherwise with the corresponding adjacent outer segment. Once the segment has extended to its proper length, further outward movement by the segment is prevented. That is to say, the middle 34 and inner 36 segments of the telescoping handle 24 as shown in FIG. 5 do not easily free themselves from the telescoping handle segment in which they slide. The middle telescoping 34 segment extends from the outer telescoping segment 32 until it locks as by friction with the outer telescoping segment 32. The inner telescoping segment 36 extends from the middle telescoping segment 34 and then locks by friction when it has extended its appropriate length. In order to collapse the telescoping handle 24, the telescoping handle 24 is compressed along its length to overcome the friction locks and to collapse the telescoping handle 24 to its original, folded size.

At the end of the inner telescoping segment 36 is a cap 38 that is of approximately the same diameter as the outer telescoping segment 32. The inner telescoping handle segment 36 is centrally attached to the cap 38. The diameter of the telescoping handle cap 38 serves for a convenient means of gripping the two opposing ends of the telescoping handle 24 (one by the outer telescoping segment 32, the other by the telescoping handle cap 38) as the cap 38 has a greater diameter than the connected inner telescoping segment 36. This particular diameter of the telescoping handle cap 38 serves to provide an attractive uniform appearance to the handle 24 when it rests within the compact 12 as shown in FIG. 3 while also providing structural stability when joined to the rigid platform portion 30 of the applicator base 26.

The telescoping handle cap 38 has two oppositely opposing tab pins 40*a*, 40*b* as shown in FIGS. 3 and 4. The tab pins 40*a*, 40*b* are small posts that extend laterally outward in opposite directions perpendicular to the axis of the telescoping handle 24. The tab pins 40*a*, 40*b* extend outward from the cap 38 to provide means by which the telescoping handle 24 may be pivotally and removably attached to the applicator base 26. The tab pins 40*a*, 40*b* of the cap 38 snap fit within two tab pin holders 28*a*, 28*b* present on the rigid platform 30 of the applicator base 26 of the present invention.

As shown in FIGS. 4 and 5, pivotally coupled to the telescoping handle 24 is the applicator base 26. The applicator base 26 has two primary portions. The first portion is a rigid platform portion 30 that serves to provide support for an applicator pad 42 as well as to provide a sound and sturdy point of structural attachment for the telescoping handle 24. The second portion of the applicator base is the applicator pad 42. The rigid platform portion 30 of the applicator base 26 is approximately three inches in diameter and approximately one-quarter (¼) inch thick. The rigid platform 30 does not need to be exceedingly thick, but should have a thickness that can withstand the recurring stresses of having lotion L applied to the body of the sunbather S over an extended period of time. Such thicknesses may also be on the order of one-half to three-eighths inch thick.

Centrally located to the rigid platform 30 are two tab pin holders 28*a*, 28*b*. The tab pin holders 28*a*, 28*b* are approximately as far apart as the diameter of the telescoping handle 24, but preferably just slightly less in order to snugly hold the collapsed telescoping handle 24 between them. Each tab pin holder 28*a*, 28*b* is approximately semi-circular in shape extending upward from the rigid platform 30. Each tab pin holder 28*a*, 28*b* has a central slot 44 facing upward that leads into a central aperture 46. The central slot 44 and aperture 46 of each tab pin holder 28*a*, 28*b* serve to guide and lock in place corresponding tab pins 40*a*, 40*b* located on the telescoping handle cap 38. When the telescoping handle 24 is brought into contact with the rigid platform 30, the tab pins 40*a*, 40*b* of the cap 38 are set into the slots 44 of the tab pin holders 28*a*, 28*b*. The tab pins 40*a*, 40*b* are then pressed into the apertures 46 via the slots 44 in order to lock the telescoping handle 24 pivotally into place relative to the rigid platform 30.

Attached to the bottom of the rigid base 30 is a soft pad 42 that actually applies the lotion L to the skin of the sunbather S. The pad 42 is circular in shape and attaches as by adhesive 48 to the face opposite the telescoping handle 24 of the rigid platform 30. Such adhesive attachment of the pad portion 42 of the applicator 26 includes peel and stick pads that are readily available in the art. In one embodiment, when the applicator of the present invention is delivered to the sunbather S, the peel and stick adhesive 48 of the pad can be covered with a backing strip 50 allowing the sunbather S to attach the pad 42 to the rigid platform 30. The pad 42 is preferably soft and durable, able to absorb suntan lotions, as well as able to be washed thoroughly to remove such lotions. The pad 42 is preferably made of an absorbent, resilient, durable, and soft material so that suntan lotion L will be absorbed by the pad 42, so that the pad 42 can undergo the stresses that accompany the application of lotion L to the skin of the sunbather S, and so that the pad 42 does not abrade the skin of the sunbather S when lotion L is applied. Such material may include urethane, neoprene, or other rubber, whether natural or artificial, or suitable soft plastics. The pad 42 should be washable so that excess or old lotion may be removed from the pad by washing as with detergent or soap. Preferably, the pad 42 is also hypoallergenic.

The lotion applicator 10 of the present invention is preferably made of a sturdy, but inexpensive material such as polypropylene or other plastic, and may be brightly colored to visually appeal to the public as when it may be vended from point of sale displays to the public on beaches, or near swimming pools, or other sunbathing areas.

The pivotable connection of the telescoping handle 24 with the applicator base 26 serves to allow the applicator base 26 to articulate with respect to the telescoping handle 24. This articulating relationship makes more convenient the application of lotion to the varying parts of the body as the angle of the applicator base 26 with respect to the handle 24 can be altered and changed to that which is most convenient for the use at hand.

When put to use, the sunbather S opens the applicator compact 12 and removes the disassembled lotion applicator 10. The folded telescoping handle 24 is removed from its resting place between the two tab pin holders 28*a*, 28*b* and is extended to its full length. The telescoping handle 24 is then joined to the applicator base 26 by snap fitting the tab pins 40*a*, 40*b* into the tab pin holders 28*a*, 28*b*. Suntan lotion L may be applied directly to the applicator pad 42 by the sunbather S, or the lotion L may first be applied to the sunbather S and spread by the applicator pad 42.

While the present invention has been described with regards to particular embodiments, it is recognized that additional variations of the present invention may be devised without departing from the inventive concept.

LIST OF REFERENCE NUMBERS AND CORRESPONDING ELEMENTS

| | |
|---|---|
| S | sunbather |
| L | lotion |
| 10 | suntan lotion applicator |
| 12 | compact portion |
| 14 | top portion |
| 16 | bottom portion |
| 18 | strap loop or clasp loop |
| 20 | cord |
| 22 | hinge |
| 24 | handle portion |
| 26 | base portion |
| 28a | two upstanding tab pin holders |
| 28b | |
| 30 | rigid platform portion |
| 32 | outer telescoping segment |

-continued

| | |
|---|---|
| 34 | middle telescoping segment |
| 36 | inner telescoping segment |
| 38 | cap |
| 40a | two oppositely opposing tab pins |
| 40b | |
| 42 | applicator pad |
| 44 | central slot |
| 46 | central aperture |
| 48 | adhesive |
| 50 | backing strip |

What I claim is:

1. A compact applicator for applying lotions and other like fluids, comprising:

a folding case, the folding case having an upper portion hingeably attached to a lower portion, the upper and lower portions defining a cavity between them;

a telescoping handle having a width and a plurality of nested segments, an innermost nested segment terminating in a cap having two oppositely opposed tab pins, the telescoping handle fitting within the case cavity when the telescoping handle is collapsed;

an applicator base, the applicator base fitting within the case cavity and having a first substantially flat applicating surface and a second handle-engaging surface, the second handle engaging surface having a pair of oppositely opposed tab pin holders centrally located on the second handle-engaging surface, the tab pin holders spaced apart a distance slightly less than the width of the telescoping handle; whereby the collapsed telescoping handle fits snugly between the tab pin holders to form a base-handle pair, the base-handle pair fitting within the folding case so that it may completely close.

2. The compact applicator of claim 1 wherein the tab pins of the telescoping handle correspond to and detachably fit within the tab pin holders of the base so that the telescoping handle may be repeatedly detachably attached to the base.

3. The compact applicator as set forth in claim 1, wherein the applicator base further comprises:

an absorbent lotion pad attached to the first flat applicating surface.

4. The compact applicator as set forth in claim 3, wherein the absorbent lotion pad is made of foam rubber.

5. A compact lotion applicator, comprising:

a folding case defining an interior cavity, the folding case having an upper portion and a lower portion, the lower portion hingedly attached to the upper portion, the upper and lower portions defining the interior cavity between them; and a collapsible applicator, the collapsible applicator fitting within the interior case cavity when collapsed, the collapsible applicator having a telescoping handle and an applicator base, the applicator base detachably attaching to the telescoping handle.

6. The compact lotion applicator of claim 5, wherein the telescoping handle further comprises a plurality of similar nested handle segments, an innermost one of the nested handle segments terminating in a cap having a pair of outwardly extending tab pins.

7. The compact lotion applicator of claim 5, wherein the applicator base further comprises:

a first, generally flat applicating surface; and a second handle-engaging surface, the handle engaging surface having a pair of tab pin holders centrally located upon the second handle-engaging surface in a spaced-apart relationship allowing two tab pins present on the telescoping handle to fit between the tab pin holders and to securely engage the applicator base.

8. The compact lotion applicator of claim 7, wherein the applicator base further comprises:

a substantially rigid, handle-engaging portion; and a substantially soft and absorbent lotion applicating portion.

9. The compact lotion applicator of claim 8, wherein the lotion applicating portion is made of durably washable foam rubber adhesively attached to the substantially rigid portion.

* * * * *